US006516174B1

(12) United States Patent
Aoki et al.

(10) Patent No.: US 6,516,174 B1
(45) Date of Patent: Feb. 4, 2003

(54) DEVELOPING APPARATUS HAVING DEVELOPER REGULATING BLADE

(75) Inventors: Shinji Aoki, Yokohama (JP); Takao Izumi, Yokohama (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/906,097

(22) Filed: Jul. 17, 2001

(51) Int. Cl.[7] ..... G03G 15/08
(52) U.S. Cl. ..... 399/284
(58) Field of Search ..... 399/284, 274, 399/279, 281, 283, 350, 351; 118/261

(56) References Cited

U.S. PATENT DOCUMENTS 5,170,213 A * 12/1992 Yamaguchi et al. ..... 399/281
5,369,478 A * 11/1994 Kobayashi et al. ..... 399/236
5,768,670 A * 6/1998 Enomoto et al. ..... 399/284
5,895,150 A * 4/1999 Watabe et al. ..... 118/261
5,933,692 A * 8/1999 Niwano et al. ..... 399/284

FOREIGN PATENT DOCUMENTS

JP 2000039765 A * 2/2000 ..... G03G/15/08
JP 2000047478 A * 2/2000 ..... G03G/15/08
JP 2001092245 A * 4/2001 ..... G03G/15/08

* cited by examiner

*Primary Examiner*—Robert Beatty
(74) *Attorney, Agent, or Firm*—Foley & Lardner

(57) ABSTRACT

The developing apparatus includes a developer roller for supplying a developing agent to an electrostatic latent image carried on a photosensitive belt such as to visualize it, and a layer thickness regulating device for regulating a thickness of a layer of the developing agent on the developer roller to a constant thickness, wherein the layer thickness regulating device further includes a metal-made support spring member having a bent portion in the middle there of, and an elastic member set on the support spring member via a metal-made substrate having a thickness larger than that of the support spring member, such as to be brought into contact with the developer roller.

17 Claims, 3 Drawing Sheets

DEVELOPING APPARATUS HAVING DEVELOPER REGULATING BLADE

BACKGROUND OF THE INVENTION

The present invention relates to a developing apparatus and an image forming apparatus, which are built in, for example, a photocopier or a printer in which electronic photography is applied.

A photocopier or printer of the above-mentioned type includes a photosensitive member for carrying an electrostatic latent image. As a developer is applied to the electrostatic latent image carried on the photosensitive member by the developing apparatus, the latent image is visualized.

A developing apparatus includes a developing roller for supplying a developer and a layer thickness regulating blade for regulating the thickness of a layer of the developer on the developing roller, to keep the thickness at constant.

In general, a layer thickness regulating blade has a structure in which a flat-plate elastic member is adhered with an adhesive to a metal plate having a straight shape, and the elastic member is set to be in contact with the photosensitive member.

However, the conventional layer thickness regulating blade entails the following drawbacks.

That is, in the case where the metal plate to which the elastic member is adhered is thick, such a thick plate will not substantially exhibit a physical property as a plate spring, and therefore the contact force of the elastic member with respect to the developing roller is greatly influenced by variations between developing apparatus which result during the assembly. For this reason, it is conventionally difficult to control the contact force of the elastic member with respect to the developing roller at a constant value.

On the other hand, in the case where the metal plate of the thickness regulating blade is thin, it is possible to control the pressure force of the elastic member by utilizing the physical property of the plate spring. However, if the metal plate is thin, such a phenomenon that the metal plate itself is distorted due to expansion/contraction due to the hardening of the adhesive, frequently occurs.

If the metal plate is thin, it can be easily deformed, and therefore the elastic member cannot be pressed on the metal plate at a high pressure during the adhesion of the elastic member. Consequently, the adhesive cannot be applied evenly on the adhesion surface of the elastic member, resulting in, for example, uneven application of the adhesive.

Further, when the metal plate is of a shape other than a straight type, it is very difficult to evenly apply the adhesive on the adhesive surface.

These drawbacks appear as a cause for the uneven density of a toner image on a photosensitive member, which will create a further serious problem.

BRIEF SUMMARY OF THE INVENTION

The present invention has been achieved as a solution to the above-described problem and the object thereof is to provide a developing apparatus and an image forming apparatus, which do not create a distortion in the support sprint member or do not cause an uneven adhesion or the like even if the metal-made support spring member is thin, but capable of that an elastic member is mounted properly.

According to the present invention, there is provided a developing apparatus comprising: a developing agent supplying device for supplying a developing agent to an electrostatic latent image carried on an image carrier such as to visualize it; and a layer thickness regulating device for regulating a thickness of a layer of the developing agent on the developing agent supplying device to a constant thickness, wherein the layer thickness regulating device further comprises a metal-made support spring member, and an elastic member set on the support spring member via a metal-made substrate having a thickness larger than that of the support spring member, such as to be brought into contact with the developing agent supplying device.

According to the present invention, there is further provided a developing apparatus comprising:

a latent image forming device for forming an electrostatic latent image on an image carrier;

a developing device for supplying a developing agent to the electrostatic latent image such as to visualize it; and a transfer device for transferring a visualized image visualized by the developing device onto a transfer member, wherein the developing device further comprises a developing agent supplying device for supplying a developing agent to the electrostatic latent image carried on the image carrier such as to visualize it; and a layer thickness regulating device for regulating a thickness of a layer of the developing agent on the developing agent supplying image to a constant thickness, wherein the layer thickness regulating device further comprises a metal-made support spring member, and an elastic member set on the support spring member via a metal-made substrate having a thickness larger than that of the support spring member, such as to be brought into contact with the developing agent supplying device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

Embodiments of the present invention will now be described with reference to accompanying drawings.

Figure 1:
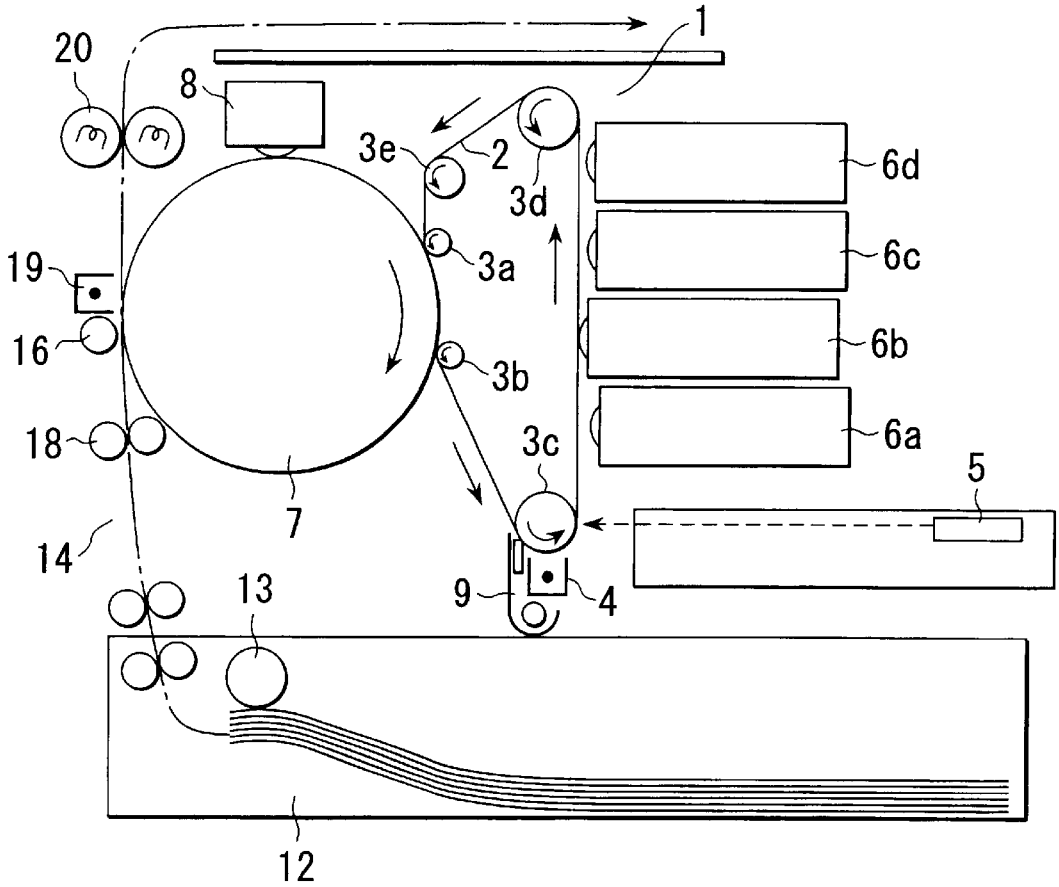
FIG. 1 is a diagram schematically showing a color electrophotographic copying machine according to an embodiment of the present invention.

FIG. 1 is a structural view of a color electrophotographic copying machine as an image forming apparatus according to an embodiment of the present invention.

The color electrophotographic apparatus has an image forming unit 1. The image forming unit 1 has a photosensitive belt 2 serving as an image carrier. The photosensitive belt 2 is put across a plurality of first to fifth rollers 3*a* to 3*e* at a predetermined tension such as to run in a direction indicated by an arrow.

To surround the photosensitive belt 2 along its running direction, there are provided a charger device 4 for charging the photosensitive belt 2 at a predetermined potential, an exposure device 5 for forming an electrostatic latent image on the charged photosensitive belt 2, and first to fourth developing devices 6*a* to 6*d* for supplying toner to the latent image formed on the photosensitive belt 2 so as to visualize it. Around the photosensitive belt 2 also in its running direction, there are provided a rotatable intermediate transfer member 7 for temporarily holding the toner image formed on the photosensitive belt 2, and a cleaner device 9 for eliminating toner remaining on the photosensitive belt 2. Further, on an upper section of the intermediate transfer member 7, there is provided a cleaner 8 for cleaning the intermediate transfer member 7.

The portion of the photosensitive belt 2, which is put across the first and second rollers 3*a* and 3*b*, is brought into tight contact with the outer circumferential surface of the intermediate transfer member 7, and the other portion which is put across the third and fourth rollers 3*c* and 3*d* is set to oppose the developing device with a certain gap thereto.

It should be noted here that a drive motor (not shown) is connected to any one of the first to fifth rollers 3*a* to 3*e*, and the first to fifth rollers 3*a* to 3*e* are rotated in a direction indicated by the arrows at a predetermined speed by the rotation of the drive motor.

Underneath the image forming unit 1, there is provided a sheet cassette 12 for containing sheets P serving as transfer members having a predetermined size. The sheet cassette 12 is provided with a paper feeding roller 13 for feeding out the sheets P one by one.

Between the sheet cassette 12 and the intermediate transfer member 7, there is a conveying system 14 for transferring a sheet P towards the intermediate transfer member 7. A transfer roller 16 is provided in the conveying system 14 such as to oppose the intermediate transfer member 7, and thus a toner image formed on the intermediate transfer member 7 is transferred on a paper sheet P.

It should be noted that an aligning roller 18 is provided on an upstream side of the transfer roller 16 in the sheet-conveying direction. The aligning roller 18 temporarily stops a sheet P being conveyed by the conveying system 14 in order to correct inclination of the sheet P with respect to the conveying direction and further set the leading end of the sheet P to coincide with the leading end of the toner image formed on the intermediate transfer member 7.

On a downstream side of the transfer roller 16 in the sheet conveying direction, there are provided a separating device 19 for separating the sheet P on which the toner image has been transferred, from the intermediate transfer member 7 by applying an AC charge thereto, and a fixing device 20 for fixing the toner image which has been transferred on the sheet P to the sheet P.

Next, the full-color printing operation by the color electrophotographic apparatus will now be described.

First, the surface of the photosensitive belt 2 rotated by the charger device 4 is charged uniformly at a predetermined potential. Then, the photosensitive belt 2 is exposed by a mode corresponding to a yellow image by the exposure device 5, thereby forming a latent image. Thus formed latent image on the photosensitive belt 2 is developed as yellow toner is supplied from a yellow developing device 6*a* thereto, and the developer image is further transferred onto the intermediate transfer member 7. After the transferring of the image, the photosensitive belt 2 is separated from the intermediate transfer member 7 and then it is discharged with light by a discharger (not shown). Subsequently, toner remaining on the photosensitive belt 2 without having been transferred to the intermediate transfer member 7 is cleaned by the cleaner device 9. The removed toner by the cleaning is collected in a waste toner box (not shown). Subsequently, toner remaining on the photosensitive belt 2 without having been transferred to the intermediate transfer member 7 is cleaned by the cleaner device 9. The removed toner by the cleaning is collected in a waste toner box (not shown).

After a while, the photosensitive belt 2 is re-charged by the charger device 4, and is exposed by a mode corresponding to a magenta image by the exposure device 5, thereby forming a latent image. Thus formed latent image on the photosensitive belt 2 is developed with magenta toner by a magenta developing device 6*b* thereto, and the magenta toner image is further transferred as it is superimposed onto the intermediate transfer member 7. A similar step is repeated for a cyan image and black image, and thus an image of four colors superimposed one on another is formed on the intermediate transfer member 7.

After the image formation, a sheet P is fed between the intermediate transfer member 7 and the transfer roller 16 and the four-color toner image is secondarily transferred in batch onto the sheet P. The sheet which carries the four-color toner image is separated from the intermediate transfer member 7 by the separation charger 19, and then passed on to the fixing device 20, where the toner image is fixed thus obtaining a color image.

On the other hand, a portion of toner which has not been transferred onto the sheet P, remains on the intermediate transfer member 7, and in order to remove it, the intermediate transfer member 7 is cleaned after completion of the secondary transfer by bringing the cleaner into contact with the intermediate transfer member 7.

It should be noted that as the above-described four-color image is being formed on the intermediate transfer member 7, the cleaner 8 is kept separated from the intermediate transfer member 7.

Figure 2:
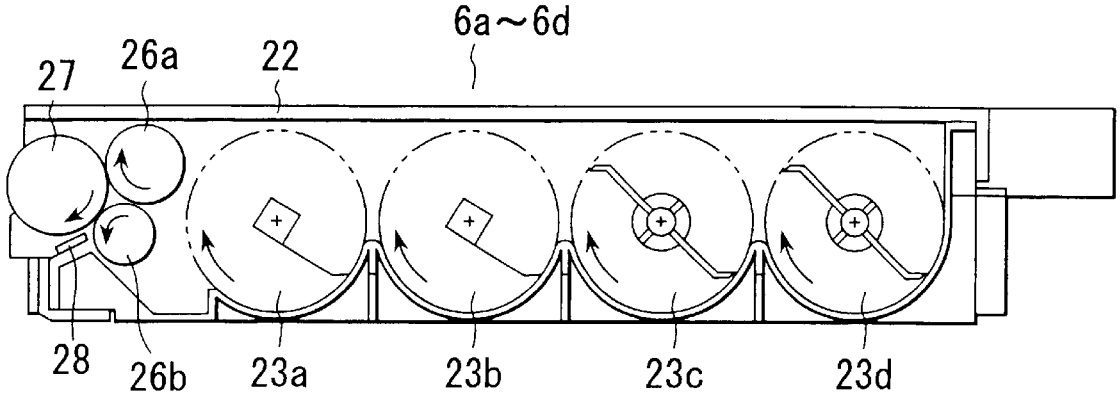
FIG. 2 is a diagram showing an inner structure of a developing device equipped with a toner layer regulating blade, in the present invention.

FIG. 2 is a diagram showing a common structure of developing devices 6*a* to 6*d* of a non-magnetic one component type described above.

The developing devices 6*a* to 6*d* each are equipped with a developer container 22 for containing a non-magnetic one-component toner. In the developer container 22, a plurality of (four in this embodiment) conveyer springs 23*a* to 23*d* for conveying toner are provided. In the front section of the conveying spring 23*a*, supply rollers 26*a* and 26*b* and a developer roller 27 are provided. Underneath the developer roller 27, there is provided a layer thickness regulating blade 28 serving as a layer thickness regulating device, for regulating a toner layer on the developer roller 27 at a constant thickness.

An aluminum sleeve having a surface coarseness Rx of 3.0 $\mu$m is used in the developer roller 27. Each of the supply rollers 26*a* and 26*b* employs a polyurethane foam member having a diameter of 14.2 mm, which includes a metal rod having a diameter of 6 mm along its central axis.

During the development, the conveyer springs 23*a* to 23*d* are rotated and the toner is conveyed by the rotation of the springs to the supply rollers 26*a* and 26*b*. The conveyed toner is supplied to the developer roller 27 by the rotation of the supply rollers 26*a* and 26*b*. The toner supplied to the developer roller 27 is regulated by the layer thickness regulating blade 28 so that the thickness of the toner layer becomes constant. After the thickness of the toner layer on the developer roller 27 is made constant, the toner is supplied onto the latent image formed on the photosensitive belt 2 so as to visualize it.

Figure 3:
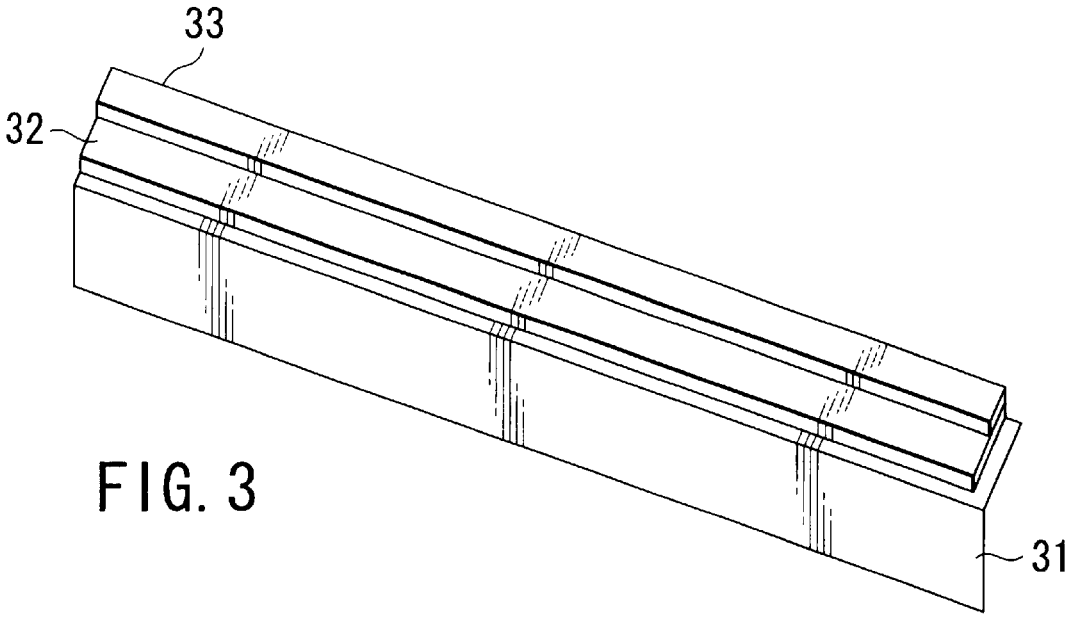
FIG. 3 is a perspective view of the toner layer regulating blade.
Figure 4:
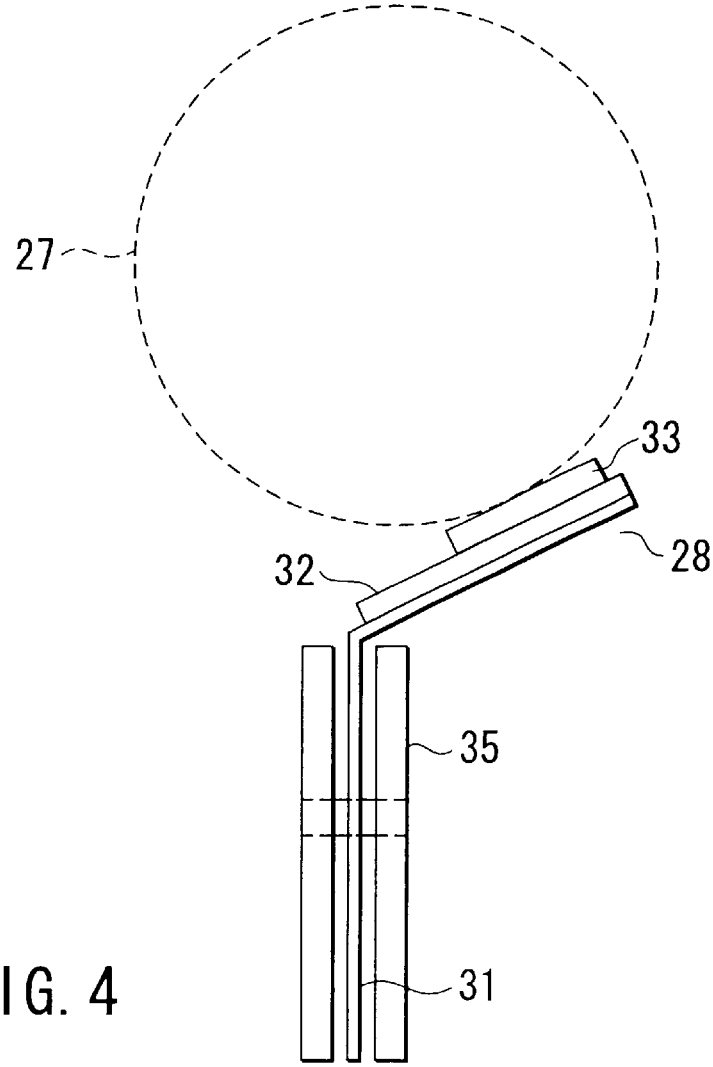
FIG. 4 is a front view of the toner layer regulating blade.

FIG. 3 is a perspective view of the toner layer thickness regulating blade 28, and FIG. 4 is a front view thereof.

The layer thickness regulating blade 28 has a thin metal-made plate spring member 31, and a metal-made substrate 32 having a predetermined thickness which is larger than that of the plate spring member 31 is provided on the upper side of the spring member 31. An elastic member 33 made of a high polymer material is provided on the substrate 32. The plate spring member 31 of the layer thickness regulating blade 28 is fixedly held by a bracket 35. The elastic member 33 and the substrate 32 are fixed together by an adhesive or a double-sided tape. If the material of the elastic member 33 is a silicone rubber, polyurethane elastomer or the like, it can be formed to be integrated with the substrate 32.

The substrate 32 and the plate spring member 31 are fixed together by an adhesive or a double-side tape. As the material for the substrate 32, various types of metals or alloys such as copper, copper alloy, steel, stainless steel, aluminum ally, zinc and zinc alloy, can be used regardless of whether or not the material has a spring property.

It is generally preferable that the substrate 32 should be made of a stainless steel or a copper alloy having a high anti-corrosion property. In the case of the stainless steel, it is necessary to pay attention to its suitability to the high-polymer material which constitutes the elastic member 33. An appropriate thickness of the substrate 32 ranges from 0.1 mm to 0.5 mm. It is preferable that the hardness of the elastic material 33 should be that selected in a range of 20 to 90° in value measured by Asker-C type hardness meter.

It is required that the plate spring member 31 should have a spring property, and therefore a copper alloy, steel, stainless steel or the like is preferable for the material of the plate spring member 31. The material for the copper alloy should preferably be phosphor bronze. The thickness of the plate spring member 31 should preferably be in a range of 0.04 to 0.2 mm in the case of stainless steel, or it should be in a range of 0.05 to 0.4 mm in the case of phosphor bronze.

During the formation of an electrostatic latent image, an uneven image density appears in an outputted image in the main scanning direction of the exposure device (a laser optical system). In other words, each line running in the conveying direction of the sheet, which constitutes the image, shows unevenness in image density.

The uneven image density is caused by uneven contact pressure between the developer layer thickness regulating blade 28 and the developer roller 27. Therefore, by monitoring the uneven density of the output image by eye, the accuracy of the contacting manner of the thickness regulating blade 28 to the developer roller 27 can be determined.

Figure 5:
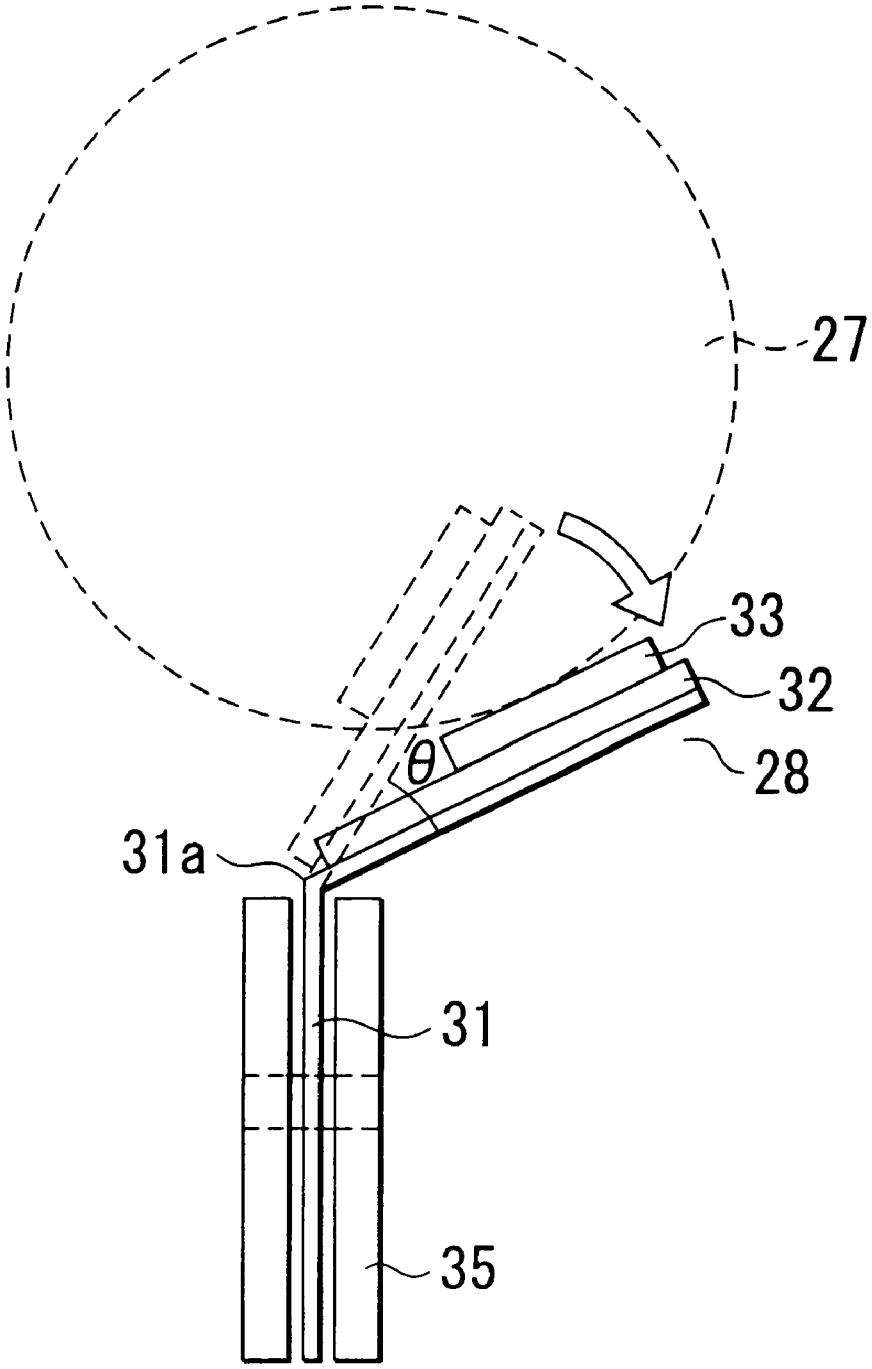
FIG. 5 is a front view of the toner layer regulating blade in such a state that it is brought into contact with the developing roller, thereby causing the plate spring plate to elastically bend.

FIG. 5 is a diagram illustrating how the thickness regulating blade 28 is brought into contact with the developer roller 27.

Since the plate spring member 31 of the layer thickness regulating blade 28 is fixed to the bracket 35, the pressure of the elastic member 33 onto the developer roller 27 is determined substantially by the material and thickness of the plate spring member 31 and the distance from a bent portion 31*a* of the plate spring member 31 to the contact position between the developer roller 27 and the elastic member 33, and a bent angle θ of the plate spring member 31.

Based on the contact position between the developer roller 27 and the elastic member 33, and the material of the plate spring member 31, the pressure of the elastic member 33 onto the developer roller 27 is determined substantially by the thickness of the plate spring member 31 and the bent angle θ thereof. Therefore, by reducing the thickness of the plate spring member 31, it becomes possible to widen the design value for the bent angle θ and therefore the accuracy of control of the pressure can be improved.

TABLE 1

| Members & Adhesives | Example 1 | Example 2 | Example 3 | Comparative Example 1 | Comparative Example 2 | Comparative Example 3 |
|---|---|---|---|---|---|---|
| Elastic high-polymer | poly-urethane | poly-urethane | poly-urethane | poly-urethane | poly-urethane | poly-urethane |
| Substrate | 0.5 mm phosphor bronze | 0.5 mm phosphor bronze | 0.5 mm phosphor bronze | — | — | — |
| Plate spring | 0.06 mm SUS631-CSP | 0.06 mm SUS631-CSP | 0.06 mm SUS631-CSP | 0.06 mm SUS631-CSP | 0.06 mm SUS631-CSP | 0.10 mm phosphor bronze |
| Adhesive for highpolymer | hot melt adhesive | hot melt adhesive | bond G17 | hot melt adhesive | double-stick tape | hot melt adhesive |
| Adhesive for metals | hot melt adhesive | double-stick tape | hot melt adhesive | — | — | — |
| Uneven density of output image | ○ | ○ | ○ | X | X | X |

X
○ indicates "not substantially observed"
X indicates "prominent"

Examples of the material of the elastic member 33 are thermal-plastic elastomer and silicone rubber. As a thermal-plastic elastomer, the polyurethane type is particularly preferable.

TABLE 1 presents the results of density unevenness which appears on an outputted image when the image is formed with use of the thickness regulating blade 28 of the present invention.

As can be understood from TABLE 1, when the layer thickness regulating blade 28 of the present invention is used, the density unevenness of the outputted image is less, which indicates that a uniform pressure is applied to the contact portion between the thickness regulating blade 28 and the developer roller 27.

EXAMPLE 1

In Example 1, an urethane chip (a product of HOKUSHIN INDUSTRIES) having a rubber hardness (measured with Asker-C type hardness meter) of 67 degrees was adhered by a hot-melt adhesive onto a phosphor bronze substrate having a thickness of 0.5 mm, and then the rear surface of the phosphor bronze substrate was adhered by a hot-melt adhesive to a plate spring of SUS631·CSP having a thickness of 0.06 mm, thus forming a layer thickness regulating blade. According to this example, the result indicates that the density unevenness on the outputted image was less, and it was found that a uniform pressure was applied to the contact portion between the thickness regulating blade 28 and the developer roller 27.

EXAMPLE 2

In Example 2, an urethane chip (a product of HOKUSHIN INDUSTRIES) having a rubber hardness (measured with Asker-C type hardness meter) of 67 degrees was adhered by a hot-melt adhesive onto a phosphor bronze substrate having a thickness of 0.5 mm, and then the rear surface of the phosphor bronze substrate was adhered by a double-sided tape to a plate spring of SUS631·CSP having a thickness of 0.06 mm, thus forming a layer thickness regulating blade. According to this example, the result indicates that the density unevenness on the outputted image was less, and it was found that a uniform pressure was applied to the contact portion between the thickness regulating blade 28 and the developer roller 27.

EXAMPLE 3

In Example 3, an urethane chip (a product of HOKUSHIN INDUSTRIES) having a rubber hardness (measured with Asker-C type hardness meter) of 67 degrees was adhered by a fast-dry bond G17 (a product of KONISHI) onto a phosphor bronze substrate having a thickness of 0.5 mm, and then the rear surface of the phosphor bronze substrate is adhered by a hot-melt adhesive to a plate spring of SUS631·CSP having a thickness of 0.06 mm, thus forming a layer thickness regulating blade. According to this example, the result indicates that the density unevenness on the outputted image was less, and it was found that a uniform pressure was applied to the contact portion between the thickness regulating blade 28 and the developer roller 27.

Comparative Example 1

In Comparative Example 1, an urethane chip (a product of HOKUSHIN INDUSTRIES) having a rubber hardness (measured with Asker-C type hardness meter) of 67 degrees was adhered by a hot-melt adhesive onto a plate spring of SUS631·CSP having a thickness of 0.06 mm, thus forming a layer thickness regulating blade. According to this example, the result indicates that the density unevenness on the outputted image was prominent, and it was found that a uniform pressure was not applied to the contact portion between the thickness regulating blade 28 and the developer roller 27.

Comparative Example 2

In Comparative Example 2, an urethane chip (a product of HOKUSHIN INDUSTRIES) having a rubber hardness (measured with Asker-C type hardness meter) of 67 degrees was adhered by a double-sided tape onto a plate spring of SUS631·CSP having a thickness of 0.06 mm, thus forming a layer thickness regulating blade. According to this example, the result indicates that the density unevenness on the outputted image was prominent, and it was found that a uniform pressure was not applied to the contact portion between the thickness regulating blade 28 and the developer roller 27.

Comparative Example 3

In Comparative Example 3, an urethane chip (a product of HOKUSHIN INDUSTRIES) having a rubber hardness (measured with Asker-C type hardness meter) of 67 degrees was adhered by a hot-melt adhesive onto a plate spring of SUS631·CSP having a thickness of 0.06 mm, thus forming a layer thickness regulating blade. According to this example, the result indicates that the density unevenness on the outputted image was prominent, and it was found that a uniform pressure was not applied to the contact portion between the thickness regulating blade 28 and the developer roller 27.

As described above, according to the present invention, the elastic member 33 of the layer thickness regulating blade 28 is mounted to the metal-made plate spring member 31 via the thick metal substrate 32. With this structure, even if the plate spring member 31, which is formed thin, is deformed due to, for example, the hardening of the adhesive, the deformation energy is shut off by the metal substrate 32, and therefore the elastic member 33 will never be deformed.

Further, the elastic member 33 is mounted onto the thick metal substrate 32, and therefore the adhesion of the elastic member 33 can be done with a strong force using an adhesive or a double-sided tape. As a result, the uneven adhesion can be prevented, and further they can be formed as an integral unit by injection molding.

Thus, the elastic member 33 of the layer thickness regulating blade 28 can be brought into contact with the developer roller 27 at a uniform pressure over its entire width, and therefore a high-quality image free of density unevenness can be formed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing apparatus comprising:

a developing agent supplying device for supplying a developing agent to an electrostatic latent image carried on an image carrier so as to visualize the electrostatic latent image; and a layer thickness regulating device for regulating a thickness of a layer of the developing agent on the developing agent supplying device to a constant thickness, wherein the layer thickness regulating device further comprises:

a metal-made support spring member having a bent portion in a middle thereof, and an elastic member set on one side of the support spring member via a metal-made substrate having a thickness larger than that of the support spring member, so as to be brought into contact with the developing agent supplying device.

2. A developing apparatus according to claim 1, wherein the substrate has a thickness of 0.5 mm or less and the support spring member has a thickness of 0.04 mm or more.

3. A developing apparatus according to claim 1, wherein the substrate and the elastic member are adhered together via an adhesive or a double-sided adhesion tape, and the substrate and the support spring member are adhered together via an adhesive or a double-sided adhesion tape.

4. A developing apparatus according to claim 1, wherein the elastic member is formed to be integrated with the substrate by injection molding.

5. A developing apparatus according to claim 1, wherein the elastic member is made of a high-polymer material.

6. A developing apparatus according to claim 1, wherein the developing agent is of a non-magnetic one component type.

7. A developing apparatus comprising:

developing agent supplying means for supplying a developing agent to an electrostatic latent image carried on an image carrier so as to visualize the electrostatic latent image; and layer thickness regulating means for regulating a thickness of a layer of the developing agent on the developing agent supplying image to a constant thickness, wherein the layer thickness regulating means further comprises:

a metal-made support spring member having a bent portion in a middle thereof, and an elastic member set on one side of the support spring member via a metal-made substrate having a thickness larger than that of the support spring member, so as to be brought into contact with the developing agent supplying device.

8. An image forming apparatus comprising:

a latent image forming device for forming an electrostatic latent image on an image carrier;

a developing device for supplying a developing agent to the electrostatic latent image formed by the latent image forming device such as to visualize the electrostatic latent image; and a transfer device for transferring the visual image visualized by the developing device onto a transfer member;

wherein the developing device further comprises:

a developing agent supply device for supplying the developing agent onto the electrostatic latent image carried on the image carrier; and a layer thickness regulating device for regulating a thickness of a layer of the developing agent on the developing agent supply device to a constant thickness, and wherein the layer thickness regulating device further comprises:

a metal-made support spring member having a bent portion in a middle thereof, and an elastic member set on one side of the support spring member via a metal-made substrate having a thickness larger than that of the support spring member, so as to be brought into contact with the developing agent supply device.

9. An image forming apparatus comprising:

latent image forming means for forming an electrostatic latent image on an image carrier;

developing means for supplying a developing agent to the electrostatic latent image formed by the latent image forming means such as to visualize the electrostatic latent image; and transfer means for transferring the visual image visualized by the developing means onto a transfer member;

wherein the developing means further comprises:

developing agent supply means for supplying the developing agent onto the electrostatic latent image carried on the image carrier; and layer thickness regulating means for regulating a thickness of a layer of the developing agent on the developing agent supply means to a constant thickness, and wherein the layer thickness regulating means further comprises:

a metal-made support spring member having a bent portion in a middle thereof, and an elastic member set on one side of the support spring member via a metal-made substrate having a thickness larger than that of the support spring member, so as to be brought into contact with the developing agent supply means.

10. A developing apparatus according to claim 1, wherein a bottom surface of the metal-made substrate is fixedly disposed against a top surface of the support spring member, and wherein a bottom surface of the elastic member is fixedly disposed against a top surface of the metal-made substrate.

11. A developing apparatus according to claim 1, wherein the elastic member, the metal-made support spring member, and the metal-made substrate are separate components that are fixedly adhered to each other, so that, when the metal-made support spring member is deformed, any deformation energy caused by the metal-made support spring member being deformed is shut off from reaching the elastic member by the metal-made substrate.

12. A developing apparatus according to claim 7, wherein a bottom surface of the metal-made substrate is fixedly disposed against a top surface of the support spring member, and wherein a bottom surface of the elastic member is fixedly disposed against a top surface of the metal-made substrate.

13. A developing apparatus according to claim 7, wherein the elastic member, the metal-made support spring member, and the metal-made substrate are separate components that are fixedly adhered to each other, so that, when the metal-made support spring member is deformed, any deformation energy caused by the metal-made support spring member being deformed is shut off from reaching the elastic member by the metal-made substrate.

14. An image forming apparatus according to claim 8, wherein a bottom surface of the metal-made substrate is fixedly disposed against a top surface of the support spring member, and wherein a bottom surface of the elastic member is fixedly disposed against a top surface of the metal-made substrate.

15. An image forming apparatus according to claim 8, wherein the elastic member, the metal-made support spring member, and the metal-made substrate are separate components that are fixedly adhered to each other, so that, when the metal-made support spring member is deformed, any deformation energy caused by the metal-made support spring member being deformed is shut off from reaching the elastic member by the metal-made substrate.

16. An image forming apparatus according to claim 9, wherein a bottom surface of the metal-made substrate is fixedly disposed against a top surface of the support spring member, and wherein a bottom surface of the elastic member is fixedly disposed against a top surface of the metal-made substrate.

17. An image forming apparatus according to claim 9, wherein the elastic member, the metal-made support spring member, and the metal-made substrate are separate components that are fixedly adhered to each other, so that, when the metal-made support spring member is deformed, any deformation energy caused by the metal-made support spring member being deformed is shut off from reaching the elastic member by the metal-made substrate.

* * * * *